US008234803B2

(12) United States Patent
Gallo et al.

(10) Patent No.: US 8,234,803 B2
(45) Date of Patent: Aug. 7, 2012

(54) REFLECTIVE DEVICE FOR AN ELECTRIC FIREPLACE AND AN ELECTRIC FIREPLACE INCORPORATING THE SAME

(75) Inventors: Christopher J. Gallo, North Canton, OH (US); David M. Baker, Louisville, OH (US)

(73) Assignee: Heat Surge, LLC, North Canton, OH (US)

( * ) Notice: Subject to any disclaimer, the term of this patent is extended or adjusted under 35 U.S.C. 154(b) by 133 days.

(21) Appl. No.: 12/796,407

(22) Filed: Jun. 8, 2010

(65) Prior Publication Data

US 2011/0299283 A1 Dec. 8, 2011

(51) Int. Cl.
*G09F 19/00* (2006.01)

(52) U.S. Cl. ..... 40/428; 392/348

(58) Field of Classification Search ..... 40/428, 40/430, 431; 362/253, 234, 297, 304, 346, 362/35, 92, 127, 217.05, 269, 551, 559, 560, 362/567, 806; 472/65
See application file for complete search history.

(56) References Cited

U.S. PATENT DOCUMENTS

| | | | | |
|---|---|---|---|---|
| 1,256,645 | A * | 2/1918 | Barnett | 40/505 |
| 2,913,954 | A * | 11/1959 | Morgan | 352/2 |
| 3,430,373 | A * | 3/1969 | Shaffer | 40/430 |
| 3,499,239 | A | 3/1970 | Mungo | |
| 3,699,697 | A | 10/1972 | Painton | |
| 4,890,600 | A | 1/1990 | Meyers | |
| 4,965,707 | A | 10/1990 | Butterfield | |
| 5,003,716 | A * | 4/1991 | Dyar | 40/503 |
| 5,642,580 | A | 7/1997 | Hess et al. | |
| 6,034,609 | A * | 3/2000 | Comiskey, Jr. | 340/631 |
| 6,047,489 | A | 4/2000 | Hess et al. | |
| 6,269,567 | B1 | 8/2001 | MacPherson et al. | |
| 6,363,636 | B1 | 4/2002 | Hess et al. | |
| 6,385,881 | B1 | 5/2002 | Hess | |
| 6,393,207 | B1 | 5/2002 | Martin et al. | |
| 6,564,485 | B1 | 5/2003 | Hess | |
| 6,615,519 | B2 | 9/2003 | Hess | |
| 6,691,440 | B1 | 2/2004 | Petz et al. | |
| 6,722,066 | B1 * | 4/2004 | Cheung | 40/581 |
| 6,757,487 | B2 | 6/2004 | Martin et al. | |
| 6,944,982 | B2 | 9/2005 | Schroeter et al. | |
| 6,968,123 | B2 | 11/2005 | Ravnbo-West et al. | |
| 7,080,472 | B2 | 7/2006 | Schroeter et al. | |

(Continued)

FOREIGN PATENT DOCUMENTS

| | | |
|---|---|---|
| CN | 2424392 | 3/2001 |

(Continued)

*Primary Examiner* — Lesley D. Morris
*Assistant Examiner* — Shin Kim
(74) *Attorney, Agent, or Firm* — Sand & Sebolt

(57) ABSTRACT

A reflective device for use in an electric fireplace and a fireplace incorporating the same. The reflective device includes a shaft having a first and a second end cap mounted at opposite ends. An intermediate member extends outwardly from the shaft between the first and second end caps. One or more reflecting strips extend longitudinally between the first and second end caps and are spaced a distance away from the shaft. The reflecting strips are separated from each other by longitudinal gaps and are mounted so that they angle downwardly relative to the shaft from the intermediate member toward the first and second end caps. The shaft is rotated about its longitudinal axis so that it reflects light from a light source toward one of a screen, simulated ember bed and artificial log display in the fireplace housing.

20 Claims, 5 Drawing Sheets

U.S. PATENT DOCUMENTS

| | | | | |
|---|---|---|---|---|
| 7,134,229 | B2 | 11/2006 | Hess et al. | |
| 7,162,820 | B2 | 1/2007 | Hess et al. | |
| 7,194,830 | B2 | 3/2007 | Hess | |
| 7,236,693 | B2 | 6/2007 | Haugom | |
| 7,322,136 | B2 | 1/2008 | Chen | |
| 7,373,743 | B1 | 5/2008 | Hess | |
| 2002/0139021 | A1 | 10/2002 | Hess et al. | |
| 2003/0110671 | A1 | 6/2003 | Hess | |
| 2004/0181983 | A1 | 9/2004 | Hess et al. | |
| 2008/0181587 | A1 | 7/2008 | Patil et al. | |
| 2008/0181588 | A1 | 7/2008 | Gorby | |
| 2009/0074390 | A1* | 3/2009 | Power et al. | 392/348 |
| 2009/0080871 | A1 | 3/2009 | Chiu | |
| 2009/0126241 | A1 | 5/2009 | Asofsky | |
| 2009/0220221 | A1 | 9/2009 | Zhou | |
| 2010/0132234 | A1* | 6/2010 | Winkler | 40/431 |
| 2011/0299283 | A1* | 12/2011 | Gallo et al. | 362/282 |

FOREIGN PATENT DOCUMENTS

| | | | |
|---|---|---|---|
| CN | 2511902 | | 9/2002 |
| CN | 1416518 | | 5/2003 |
| CN | 1461398 | A | 12/2003 |
| CN | 2619181 | | 6/2004 |
| CN | 2637956 | | 9/2004 |
| CN | 1201110 | C | 5/2005 |
| CN | 2736675 | Y | 10/2005 |
| CN | 2746479 | Y | 12/2005 |
| CN | 2746480 | Y | 12/2005 |
| CN | 2747493 | Y | 12/2005 |
| CN | 2767211 | | 3/2006 |
| CN | 2786739 | Y | 6/2006 |
| CN | 2828998 | | 10/2006 |
| CN | 2847438 | | 12/2006 |
| CN | 1299049 | C | 2/2007 |
| CN | 2874697 | | 2/2007 |
| CN | 1306209 | C | 3/2007 |
| CN | 2888579 | | 4/2007 |
| CN | 100339638 | C | 9/2007 |
| CN | 201037986 | Y | 3/2008 |
| CN | 101201145 | A | 6/2008 |
| CN | 101290734 | A | 10/2008 |
| CN | 100516639 | C | 7/2009 |
| CN | 201297699 | Y | 8/2009 |
| CN | 100535507 | C | 9/2009 |
| CN | 201302221 | Y | 9/2009 |
| GB | 1164143 | | 9/1969 |

* cited by examiner

REFLECTIVE DEVICE FOR AN ELECTRIC FIREPLACE AND AN ELECTRIC FIREPLACE INCORPORATING THE SAME

BACKGROUND OF THE INVENTION

1. Technical Field

This invention generally relates to electric fireplace assemblies. More particularly, the invention relates to a reflective device for use in an electric fireplace assembly for varying the light therein so as to aid in simulating natural looking flames. Specifically, the invention relates to a reflective device and a fireplace incorporating the same where the device includes a plurality of relatively thin reflecting strips extending longitudinally between first and second end caps mounted on the ends of a rotatable shaft.

2. Background Information

Electric fireplaces have grown in popularity over recent years. One of the major hurdles that a manufacturer of such fireplaces has to overcome, is the simulation of realistic looking flames. If the simulated flames do not rise and fall and change in light intensity, then those flames appear unnatural. This leads to an aesthetically less appealing fireplace.

A number of patents have been issued for electric fireplaces and many of these patents include different mechanisms for simulating flames and for generating a flickering effect. Typically, the flickering light effect is created by incorporating a device that reflects light from a light source onto a translucent screen that is positioned rearwardly of an artificial log display and/or simulated ember bed. The reflective devices known in the prior art fall generally into three different categories. A first group of reflective devices disclosed in the prior art comprises vertically oriented ribbons or strips of reflective material. These reflective ribbons are spaced horizontally apart from each other and are subjected to some type of airflow that creates movement in the ribbon and thereby varies the light reflected therefrom. One example of a patent that discloses this type of reflective device is U.S. Pat. No. 4,965,707 issued to Butterfield, The Butterfield device includes a plurality of light-reflecting ribbons that are each cut in the shape of a flame and are individually suspended from a horizontally oriented anchor rod by a thread. A second end of each flame-shaped ribbon is secured to a second horizontally oriented anchor rod by a pin. The ribbons may be pre-twisted or suspended with an edge adjacent the screen. A breeze is generated by a fan and the ribbons twist and flutter in the breeze. Each ribbon has a reflective surface and the fluttering causes light to be reflected from the ribbons in a varied pattern.

Chinese Patent CN1416518A (Gerrard) discloses a plurality of reflective ribbons that are each connected at one end to a horizontal surface and are free at the opposite end. A fan blows air onto the ribbons and causes them to flutter and thereby reflect light shone onto the ribbons in a scattered, flickering manner.

A second group of patents disclose reflective devices which comprise some type of reflective cylinder having a pattern of apertures cut into its exterior wall. A light source is disposed in the interior of the cylinder and shines outwardly therefrom through the apertures and onto the screen. Alternatively, a light source is positioned outside of the cylinder but in such a location that light will shine through the apertures in the cylinder wall and onto the screen. The rotation of the cylinder causes interruptions in the steam of light shining onto the screen and in this manner generates a flickering effect of the light. An example of a patent that includes this type of reflective cylinder is U.S. Pat. No. 7,236,693

(Haugom). Haugom discloses a flame simulating apparatus which includes a hollow cylinder rotatable about its axis. The cylinder is mounted horizontally proximate a translucent screen in the fireplace housing and includes a sidewall with a plurality of apertures therein. The apertures are generally vertically oriented and are curvilinear in shape. A light source is disposed in the interior of the cylinder and, when activated, light is transmitted through the apertures and falls onto the back surface of the screen.

Martin (U.S. Pat. Nos. 6,393,207 and 6,757,487) also discloses a flame simulation assembly that includes a rotating hollow cylinder having a plurality of shaped openings in its outer wall. In Martin's devices the cylinder has a highly reflective interior surface. Light from the light source is transmitted into the interior of the cylinder through the openings, is reflected off the interior surface and is transmitted outwardly from the cylinder through other openings and onto the diffuser screen.

Chen (U.S. Pat. No. 7,322,136) discloses a flame simulation assembly which includes a fixed light source centered in a cover having a plurality of blades mounted between two sidewalls and separated from each other by horizontally oriented gaps. The blades have a plurality of flame-shaped apertures cut into them. Colored "flicking" boards are mounted exteriorly of the blades and rotate therewith. The blades and flicking boards rotate around the light source and light shines outwardly from the cover through the horizontal gaps, through the flame-shaped apertures and onto the screen. Preferably, the blades are curved and the curvature is such that the blades are eccentric relative to the axis of the light source. This supposedly enhances the natural looking appearance of the flickering light.

U.S. Publication Nos. 2008/0181587 (Patil et al) and 2008/0181588 (Gorby) disclose cylinders with apertures in the exterior wall and through which light shines onto a diffusion screen. Chiu (US Publication No. 2009/0080871) discloses a cylinder with apertures in its external wall and having a plurality of LED light sources disposed in the interior of the cylinder.

A third group of reflective devices disclosed in the prior art includes those comprising a shaft that is rotatable about its axis and having a plurality of reflective fingers, filaments or surfaces secured to the shaft and extending radially outwardly away therefrom. This is by far the biggest group of reflective devices disclosed in the art. Examples of patents that include this type of reflective device include U.S. Pat. Nos. 6,944,982 and 7,080,472 to Schroeter et al. These references disclose a light reflective device comprising a rotatable shaft with a plurality of light reflecting fingers extending outwardly therefrom in a variety of different directions relative to each other. The fingers are generally curved in shape and originate and terminate in the circumferential surface of the shaft.

Berry (GB 1,164,143) discloses a reflective device in which a number of jagged or saw-tooth vanes extend radially outwardly from a central shaft.

Dimplex North America Limited has a number of patents and patent applications assigned to it by the inventors Hess, Hess et al and MacPherson et al. Each of these references discloses the use of a rotatable shaft having a number of reflective fingers secured at one end to the shaft and extending generally radially outwardly therefrom. These patents and applications include U.S. Pat. Nos. 5,642,580; 6,047,489; 6,269,567; 6,363,636; 6,385,881; 6,564,485; 6,615,519; 7,134,229, 7,162,820, 7,194,830; 7,373,743; 2002/0139021; 2003/0110671; and 2004/0181983.

Additionally, U.S. Pat. No. 3,499,239 (Mungo), U.S. Pat. No. 4,890,600 (Meyers), and Painton (U.S. Pat. No. 3,699, 697) and US Publications Nos. 2009/0126241 (Asofsky) and 2009/0220221 (Zhou) each disclose a central shaft having a plurality of reflective surface extending radially outwardly away from the circumferential surface of the shaft.

A number of foreign patents, applications and utility models also show this type of reflective device including CN2767211 (Zhu Hongfeng); CN2424392Y (Chen Xiaoliang), CN2847438Y (Lin Congbao), CN2888579Y (Zhou Jun), CN2874697Y (Zhu Hongfeng), CN2828998Y (Zhu Hongfeng), CN2637956Y (Yang Wei), CN26191781Y (Yang Wei) and CN2511902Y (Ying Jianqiang).

While all of these reflective devices produce variations in light shining on the screen behind the artificial logs, there is still room in the art for an improved reflective device that aids in creating lighting that simulates a more natural looking flame effect.

SUMMARY OF THE INVENTION

The present invention comprises a reflective device that is used to create a flickering light effect in an electric fireplace and a fireplace incorporating the same. The reflective device includes a shaft having a first and a second end cap mounted at opposite ends. An intermediate member extends outwardly from the shaft between the first and second end caps. One or more reflecting strips extend longitudinally between the first and second end caps and are spaced a distance away from the shaft. The reflecting strips are separated from each other by longitudinal gaps and are mounted so that they angle downwardly relative to the shaft from the intermediate member toward the first and second end caps. The shaft is rotated about its longitudinal axis so that it reflects light from a light source toward one of a screen, simulated ember bed and artificial log display in the fireplace housing.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
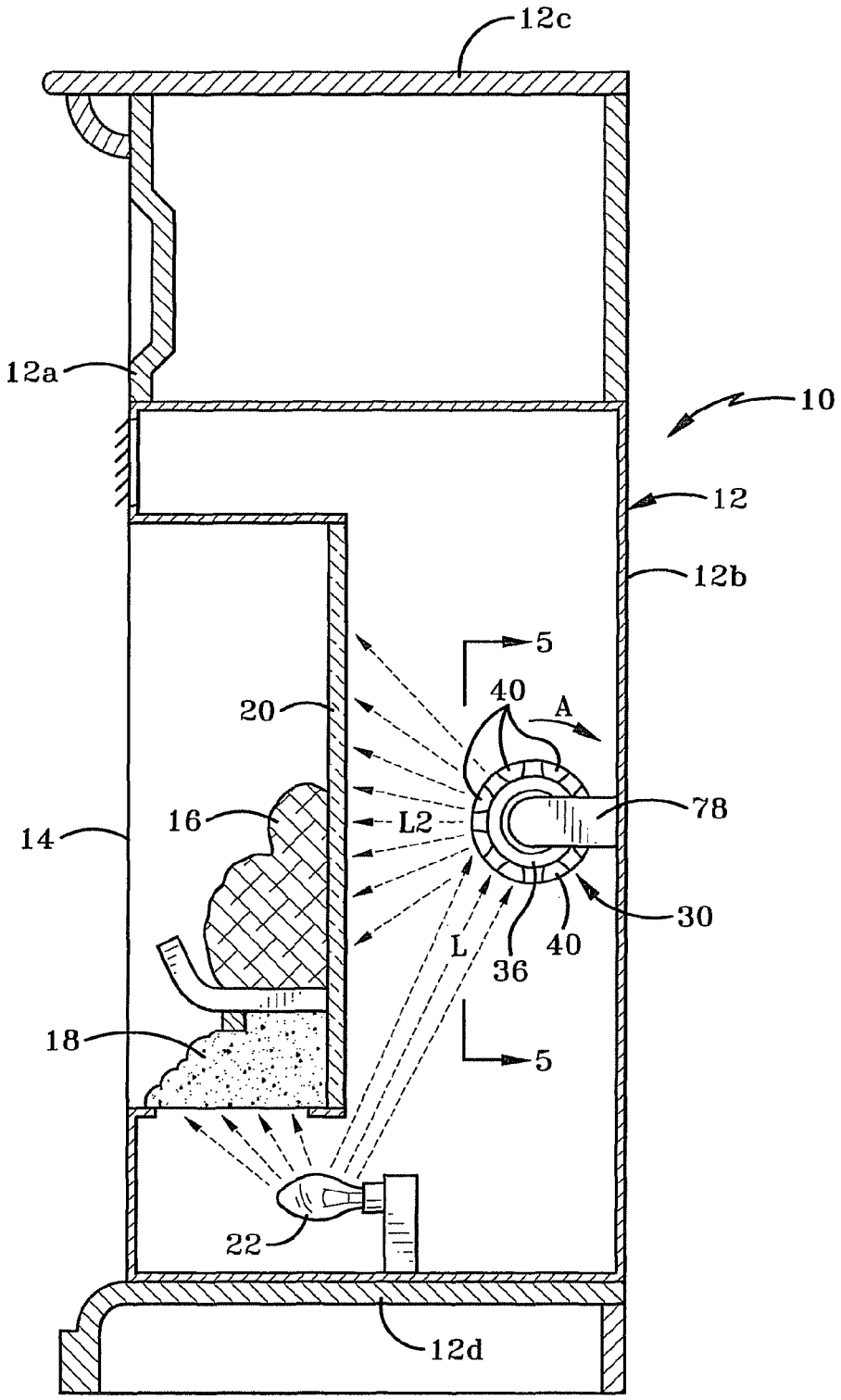
FIG. 1 is a cross-sectional side view through a fireplace assembly incorporating the reflective device of the present invention.

FIG. 1 is a cross-sectional side view of a fireplace assembly 10 that incorporates the reflective device 20 of the present invention. Fireplace assembly 10 includes a housing 12 having a front wall 12*a*, a back wall 12*b*, a top 12*c* and a bottom 12*d*. A transparent front panel 14 is provided in front wall 12*a* through which the interior of housing 12 is viewable. An artificial log display 16 is positioned above a simulated ember bed 18 and a diffusion screen 20 is positioned rearwardly of logs 16 and ember bed 18. At least one light source 22 is provided within housing 12 to light up portions of one or more of logs 16, ember bed 18, and screen 20. The lighting is set up in such as way as to create the illusion that the logs 16 and embers in the bed 18 are burning. Although not illustrated herein, the diffusion screen 20 may include flame images, be colored or be marked in such a way as to aid in creating the illusion that the viewer is looking into a wood or gas-burning fireplace. All of these components are known in the prior art.

In accordance with the present invention, a reflective device 30 is mounted within housing 12. FIG. 1 illustrates the reflective device 30 as mounted rearwardly of the screen 20 and in front of back wall 12*b*. It should be understood that reflective device 30 is positioned in such a location that it is in the path of light "L" emitted by light source 22 and that it changes the direction of that light. In the instance illustrated in FIG. 1, light source 22 is positioned between screen 20 and reflective device 30 and light L emitted from light source 22 is reflected back toward screen 20 as light "L2" by reflective device 30. Reflective device 30 may be positioned so as to reflect light into ember bed 18, into logs 16 and/or into a region slightly above logs 16. It will further be understood that more than one reflective device 30 may be utilized in fireplace 10.

Figure 2:
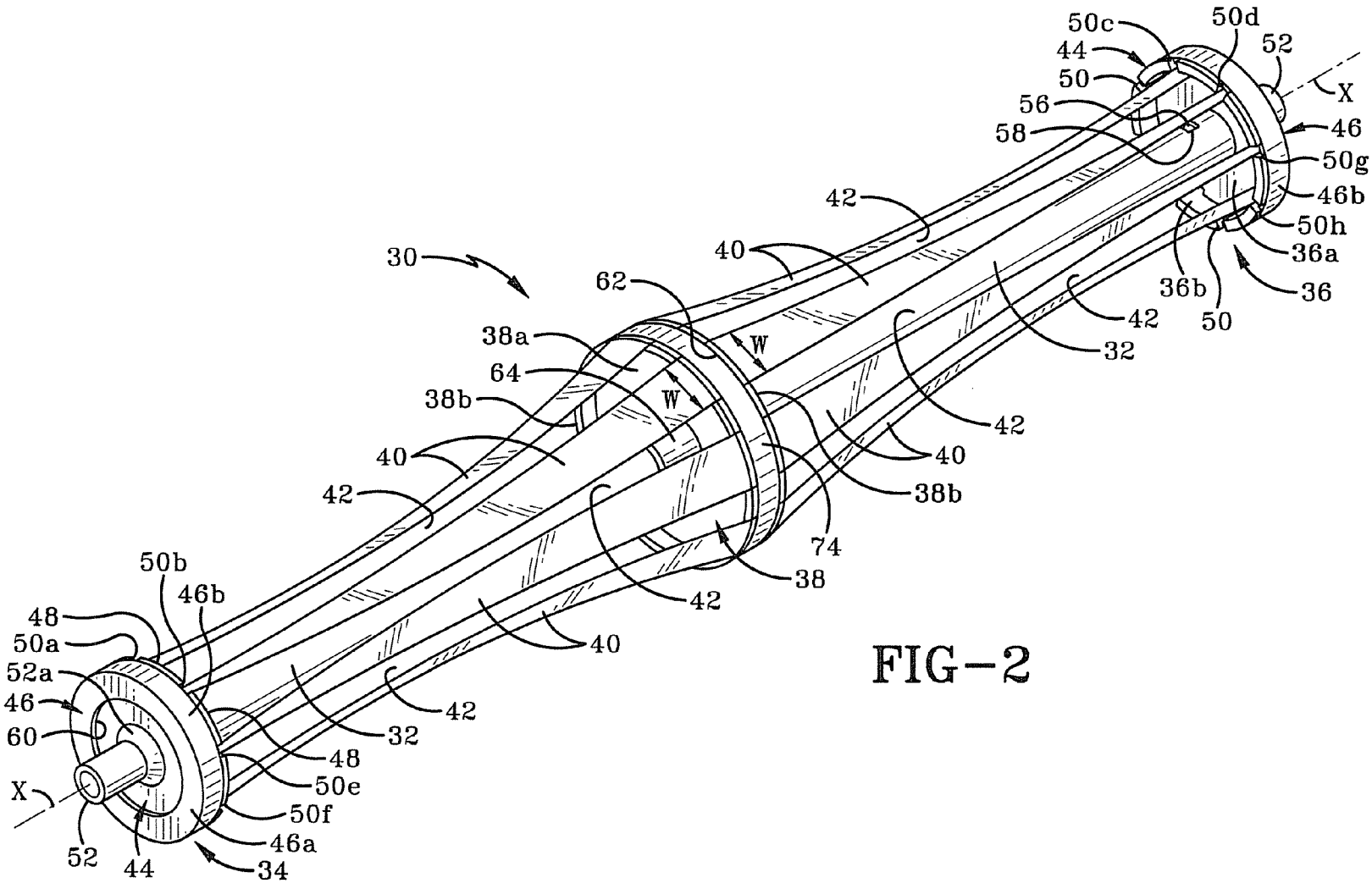
FIG. 2 is a perspective view of the reflective device of the present invention.

In accordance with a specific feature of the present invention, reflective device 30 is mounted horizontally and parallel relative to screen 20. Furthermore, it is designed to rotate about a longitudinal axis "X" (FIG. 2). The direction of the rotation "A" (FIG. 1) is such that light "L2" reflected by the reflective device 30 appears to travel vertically upwardly. This aids in creating the illusion of burning flames.

FIGS. 2-7 show reflective device 30 in greater detail. Reflective device 30 comprises an elongate central shaft 32 having a first end cap 34 engaged on a first end thereof and a second end cap 36 engaged on a second end thereof. An intermediate member 38 is engaged on shaft 32 generally midway between first and second end caps 34, 36. Each one of first and second end caps 34, 36 and the intermediate member 38 are relatively thin and preferably is generally circular in shape, although any other number of shapes may be utilized without departing from the spirit of this invention. First and second end caps 34, 36 and intermediate member 38 are engaged with shaft 32 such that they are disposed substantially at right angles to longitudinal axis "X". The first and second end caps 34, 36 and intermediate member 38 will be described in greater detail hereafter.

In accordance with yet another specific feature of the present invention, reflective device 30 preferably is provided with at least one reflecting strip 40 that extends longitudinally between first and second end caps 34, 36. Reflecting strip 40 preferably is manufactured from a material that is not rigid in nature but is, instead, soft or pliable and is capable of being moved by air currents created by a fan or merely through rotation of reflective device 30. One suitable material for use as reflecting strip 40 is aluminum foil. Furthermore, reflecting strip 40 is reflective in nature on at least the exterior surface 40*a* thereof, where the exterior surface is that surface that faces away from shaft 32. Reflecting strip 40 may also be reflective in nature on the interior surface thereof, i.e., on that surface that faces toward shaft 32. Preferably, reflecting strip 40 is reflective on both the interior and exterior surfaces as this will enhance the reflective nature of device 30.

Reflecting strip 40 preferably is relatively thin and narrow and is substantially planar when viewed in cross section.

Reflecting strip 40 has a length that is measured between the first and second end caps 34, 36. Preferably, reflecting strip has a width "W" (FIG. 4) that is disposed at right angles to the length thereof and is between ⅛ inch to 1 inch wide. A single elongate reflecting strip 40 may be threaded back and forth between first and second end caps 34, 36, or between first and second end caps and intermediate member 38. Alternatively, two or more shorter reflecting strips 40 may be threaded back and forth between first and second end caps 34, 36 or between first and second end caps and intermediate member 38. The securement and "threading" of reflecting strip 40 to first and second end caps 34, 36 will be further described hereinafter.

Figure 3:
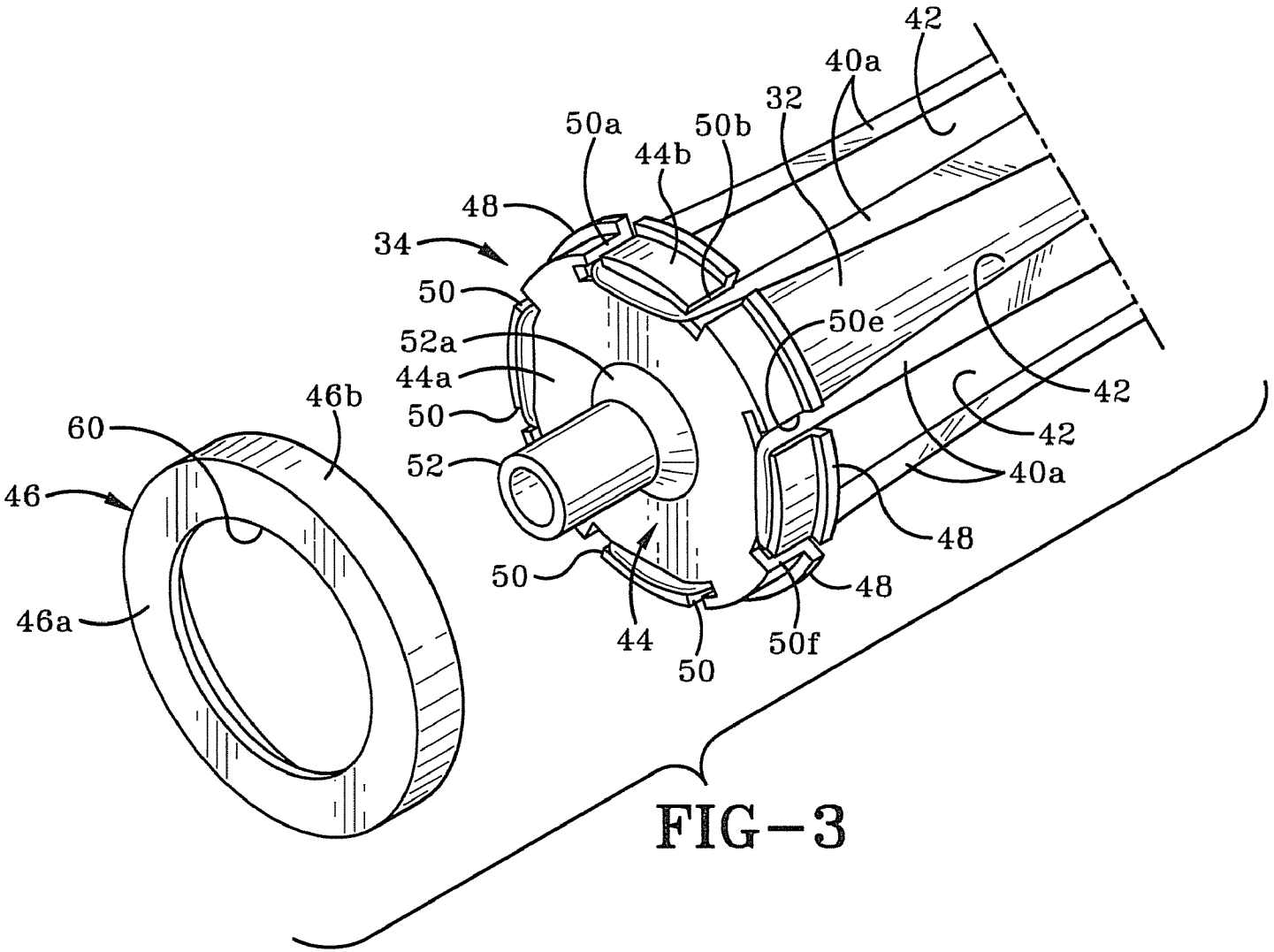
FIG. 3 is an enlarged perspective view of one end of the reflective device.
Figure 6:
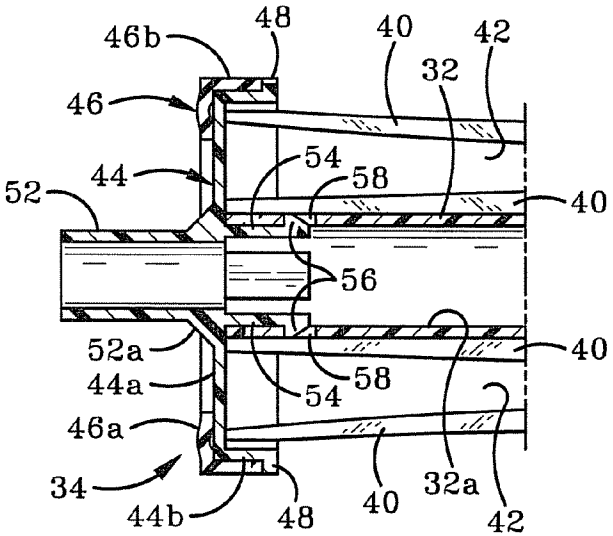
FIG. 6 is a cross-sectional front view of one end of the reflective device showing the interlocking engagement of the shaft and the end cap thereof.

Only first end cap 34 is shown in greater detail in FIGS. 3 and 6 but it should be understood that second end cap 36 is a mirror image of first end cap 34. First end cap 34 comprises a disc member 44 and a ring member 46. Disc member 44, like shaft 32, preferably is manufactured from a fairly rigid material such as plastic or metal. Disc member 44 includes a planar wall 44*a* and an annular wall 44*b*. When first end cap 34 is engaged with shaft 32, planar wall 44*a* is disposed generally at right angles to shaft 32. Annular wall 44*b* extends outwardly at right angles from a peripheral edge of planar wall 44*a*. Annular wall 44*b* terminates in an annular lip 48 which radiates outwardly from annular wall 44*b* and is disposed generally parallel to planar wall 44*a* (FIG. 6). Lip 48 extends outwardly in a direction away from shaft 32. Disc member 44 defines a plurality of slits 50 therein that are configured to receive portions of the reflecting strips 40 therethrough. Each slit 50 extends through lip 48, through annular wall 44*b* and for a short distance into planar wall 44*a*. Preferably, slits 50 are disposed parallel to each other and are spaced at regular intervals around the circumference of annular wall 44*b*.

Referring to FIG. 6, disc member 44 further includes a post 52 that extends outwardly in a first direction from an exterior surface of planar wall 44*a*, and a boss 54 that extends inwardly in a second direction from an interior surface of planar wall 44*a*. Both post 52 and boss 54 are disposed generally at right angles to planar wall 44*a* and are configured to be aligned with shaft 32 when first end cap 34 is engaged with shaft 32. The base 52*a* of post 52 may be reinforced in the region where post 52 connects to planar wall 44*a*. Both post 52 and boss 54 may be either solid or hollow.

Boss 54 is provided with at least one detent 56 on its exterior surface, preferably proximate its outermost end. Detent 56 extends outwardly away from boss 54 in the same direction as lip 48 and is configured to interlockingly engage with the first end of shaft 32. FIG. 6 shows that boss 54 is dimensioned so as to be insertable into the bore 32*a* of shaft 32. The exterior wall of shaft 32 is provided with a small slot 58 (FIG. 2) in which detent 56 from boss 54 is received when first end cap 34 is engaged with shaft 32. This interlocking engagement between detent 56 and shaft 32 prevents first end cap 34 from being accidentally disengaged from shaft 32 and also ensures that first end cap 34 rotates in unison with shaft 32. It will be understood that, instead of boss 54 being received in bore 32*a* of shaft 32, the first end of shaft 32 may be received in a bore in the boss 54. In this latter instance, the detent 56 will extend inwardly from an interior surface of boss and toward shaft 32 so that it is able to be received in slot 58 in exterior wall of shaft 32.

Second end cap 36 is interlockingly engaged with the second end of shaft 32 in a similar fashion so that second end cap 36 and shaft 32 will rotate in unison. Slot 58 and detent 56 (from second end cap 36) are visible in FIG. 2 as disposed proximate the second end of shaft 32 adjacent second end cap 36. Posts 52 of first and second end caps 34, 36 are provided to mount reflective device 30 in housing 12 and to operationally engage with the drive shaft (not shown) of a motor 76 (FIG. 5) so that reflective device 30 may be rotated about its longitudinal axis "X".

Ring member 46 includes a planar wall 46*a* and an annular wall 46*b*. Annular wall 46*b* extends outwardly from a peripheral edge of planar wall 46*a* and substantially at right angles thereto. Planar wall 46*a* defines a hole 60 therein that is of a sufficient size to allow post 52, and possibly reinforced base 52*a*, to extend therethrough when ring member 46 is engaged with disc member 44. Annular wall 46*b* is shorter than annular wall 44*b* and is designed to butt up against lip 48 when ring member 46 is engaged with disc member 44. Ring member 46 preferably is manufactured from a flexible or resilient material such as rubber so that it may be easily slid onto disc member 44 and tightly remain engaged therewith. Ring member 46 is provided to retain reflecting strips 40 in engagement with disc member 44 and to substantially prevent reflecting strips 40 from migrating out of slits 50 as reflective device 30 rotates.

As indicated previously, reflective device 30 is also provided with an intermediate member 38. Intermediate member 38 is shown in greater detail in FIGS. 4 and 7. Intermediate member 38 includes a planar wall 38*a* and an annular wall 38*b*. Planar wall 38*a* is disposed generally at right angles to shaft 32. Annular wall 38*b* is disposed generally at right angles to the planar wall 38*a* and is disposed around the peripheral edge of planar wall 38*a*. Annular wall 38*b* is generally U-shaped in cross section (FIG. 7) and defines a channel 62 therein. An annular boss 64 extends outwardly from an exterior surface of planar wall 38*a*. Boss 64 and annular wall 38*a* define a bore 66 therethrough that is oriented at right angles to planar wall 38*a* and is sized to receive shaft 32. Furthermore, boss 64 defines a pair of aligned holes 68 therein that are oriented parallel to planar wall 38*a* are in communication with bore 66. Shaft 32 defines an aperture 70 therein that is disposed at right angles to longitudinal axis "X". Holes 68 and aperture 70 are alignable and a pin 72 is inserted therethrough to lock intermediate member 38 and shaft 32 together. Because shaft 32 and intermediate member 38 are locked together, they rotate in unison.

As discussed previously, one or more reflecting strips 40 extend longitudinally between first and second end caps 34, 36. Each reflecting strip 40 is separated from the adjacent reflecting strip 40 by a gap 42. Gap 42 is between ⅛ inch to 1 inch wide. Reflecting strips 40 are disposed generally horizontally and are spaced a distance outwardly away from the exterior wall of shaft 32. Preferably, reflecting strips 40 do not contact and are not secured to shaft 32. Thus, shaft 32 is disposed as a central axis that extends through a reflective ring formed by the reflecting strips 40 and an annular space separates shaft 32 from this ring of reflecting strips 40. Since shaft 32 of reflective device 30 is disposed horizontally relative to screen 20, reflecting strips 40 are oriented substantially horizontally with respect to screen 20 and are spaced a distance rearwardly thereof.

FIGS. 2 and 3 illustrate how reflecting strips 40 are engaged with reflective device 30. If a single elongated reflecting strip 40 is used, a first end (not shown) of the reflecting strip 40 is secured to second end cap 36 either by glueing the first end of strip 40 onto one of the planar wall 36*a* or annular wall 36*b* of the second end cap 36 or by tying a knot in strip 40. The strip 40 is then extended from second end cap 36 across to first end cap 34, passing over the peripheral edges of annular wall 38*b* of intermediate member 38. At first end cap 34, reflecting strip 40 is threaded in a first direction through a first slit 50*a*, passes over a small section of planar wall 44*a* and is then threaded in a second direction through a second slit 50*b*. First slit 50*a* and second slit 50*b* comprise a first pair of series of first and second slits on first end cap 34. Reflecting strip 40 is then passed back to second end cap 36, passing over the peripheral edges of annular wall 38*b* of intermediate member 38 along the way. At second end cap 36, reflecting strip is threaded in the second direction through a first slit 50*c*, passes over a small section of second end cap 36 and is threaded in the first direction through a second slit 50*d*. First and second slits 50*c*, 50*d* are a first pair of a series of first and second slits in second end cap 36. Reflecting strip 40 is then passed back to first end cap 34, passing over peripheral edges of annular wall 38*b* once again. At first end cap 34, reflecting strip 40 is threaded in the first direction through a first slit 50*e*, passes over a small section of planar wall 44*a* and is then threaded in the second direction through a second slit 50*f*. First and second slits 50*e*, 50*f* comprises a second pair of the series of first and second slits in first end cap 34. Reflecting strip 40 is passed back over annular wall 38*b* of intermediate member 38 to second end cap 36 where it is threaded through in the first direction through first slit 50*g*, passes over a small section of planar wall 36*a* of second end cap 36 and is threaded in the first direction through second slit 50*h*. First slit 50*g* and second slit 50*h* comprise a second pair of the series of first and second slits in second end cap 36. This procedure is repeated until the reflecting strip 40 has been threaded through all of the pairs of slits 50 in the first and second end caps 34, 36. The threaded reflecting strip 40 forms a reflecting ring spaced a distance outwardly away from the shaft, and the ring of reflecting strips 40 is concentric with the shaft 32.

Once the reflecting strip 40 is in place on first and second end caps 34, 36, the ring members 46 are then slipped into engagement with first and second end caps 34, 36. When so engaged, planar wall 46*a* of one ring member 46 abuts the exterior surface of planar wall 44*a* of first end cap 34 and the planar wall 46*a* of the second ring member 46 abuts the planar wall 36*a* of second end cap 36. Additionally, annular wall 46*b* of each ring member 46 abuts the exterior surface of the annular wall 44*b*, 36*b* of the associated first and second end caps 34, 36. Ring members 46 lock reflecting strips 40 in slits 50 and prevent strips 40 from being accidentally dislodged therefrom.

A ring member 74 preferably is also slipped over intermediate member 38 and into channel 62 to lock reflecting strip 40 in abutting contact therewith. Ring member 74 substantially prevents reflecting strips 40 from bunching together about the circumference of intermediate member 38 as reflective device 30 is rotated. Instead, ring member 74 keeps the gaps 42 between adjacent pairs of reflecting strips 40 substantially constant. Ring member 74 may be made from a resilient or a rigid material such as rubber or plastic. It will be understood that ring member 74 may be omitted and, in that instance, reflecting strips 40 could merely abut the circumferential surface of intermediate member 38. Alternatively, ring member 74 may be omitted and a portion of reflecting strips 40 may be adhesively secured to the circumferential surface of intermediate member 38. Still further, intermediate member 38 may be provided with a plurality of slits similar to slits 40 provided in first and second end caps 34, 36 and a portion of each reflecting strip 40 may be fed through these slits. Alternatively, reflecting strips may be threaded separately between slits in first end cap 34 and slits in intermediate member 38 and different reflecting strips may be threaded between slits in intermediate member 38 and slits in second end cap 36. Intermediate member 38 supports the reflecting strips 40 a spaced distance away from shaft 32 and, in cooperation with ring member 74, keeps them spaced a distance away from each other. It should be understood that the shape of intermediate member 38 may be varied in any desired manner. Furthermore, it is contemplated that intermediate member 38 could be entirely omitted from reflective device 30 and that the reflecting strips 40 would then simply extend from first end cap 34 to second end cap 36 without contacting any other component of reflective device 30 thereinbetween. Alternatively, two or more intermediate members 38 could be positioned on shaft 32 between first and second end caps 34, 36 without departing from the spirit of the present invention.

Preferably, first and second end caps 34, 36 are equal in diameter and intermediate member 38 is of a greater diameter than both of the first and second end caps 34, 36. Reflecting strip 40 is secured to a region proximate the peripheral outer edge of each of the first and second end caps 34, 36 and engages the peripheral outer surface of intermediate member 38. Consequently, reflecting strip 40 is secured to each of the first and second end caps 34, 36 a first distance away from the exterior surface of shaft 32 and engages the peripheral outer edge 38*b* of intermediate member 38 a second distance away from the exterior surface of shaft 32. Since the diameter of intermediate member 38 is greater than the diameters of first and second end caps 34, 36, the second distance is greater than the first distance. Consequently, reflecting strip 40 angles downwardly relative to the exterior surface of shaft 32 from the intermediate member 38 toward one or both of first and second end caps 34, 36. This aids in putting a slight angle on reflecting strips 40 so that light "L2" reflected therefrom is more diffuse when it reaches screen 20.

It will, however, be understood that intermediate member 38 may be of the same diameter as first and second end caps 34, 36 or may be of a somewhat smaller diameter than each of first and second end caps 34, 36.

Figure 4:
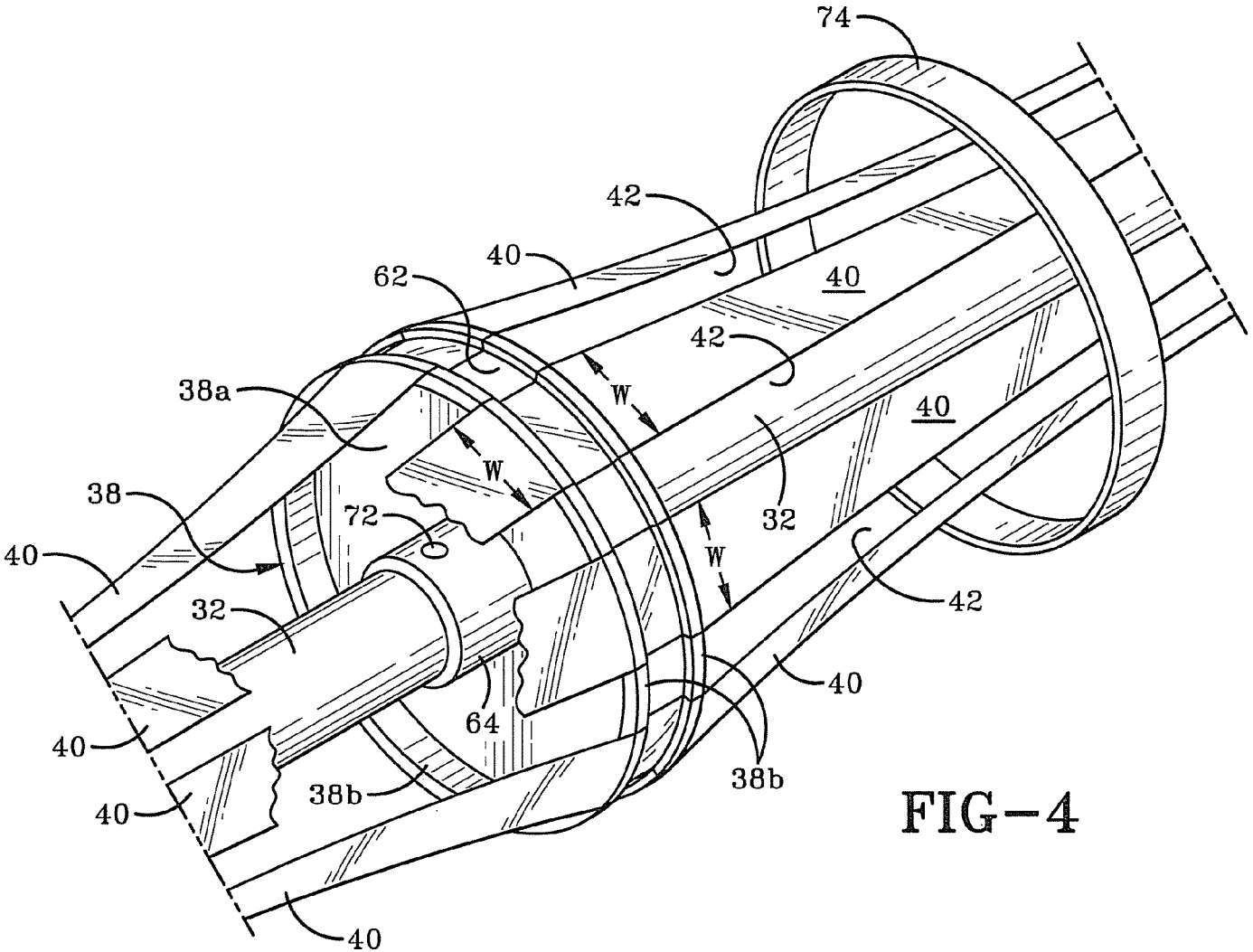
FIG. 4 is an enlarged perspective view of the central region of the reflective device.

As is evident from FIG. 3, the width of each slit 50 is substantially smaller than the maximum width "W" of the reflecting strip 40*s* (FIG. 4). Thus, the width of strip 40 proximate each of first and second end caps 34, 36 must be substantially reduced in order to enter slit 50. This may be accomplished by providing a reflecting strip 40 that is specially manufactured to be of a certain length and includes regions that are wider and other regions that are narrower. Alternatively, the width of reflecting strip 40 may be constant along its entire length and the narrowed regions of strip 40 are formed by compressing the appropriate region of the strip 40 toward each other so that the compressed region may be fed through the slit 50. This latter method is somewhat advantageous as it causes portions of the strip 40 to be disposed at slightly different angles relative to each other and thereby changes the strip's ability to reflect light off the same. Instead of the light "L2" being directed in a uniform manner from the strip 34, it is scattered in all different directions.

It should be further noted that, preferably, the reflecting strips 40 are not retained between the first and second end caps 34, 36 and the intermediate member 38 in such a fashion that they are pulled taut. Instead, it is preferable that there is a little slack in the reflecting strips 40. Then, when reflective device 30 is rotated, as will be hereinafter described, the reflecting strips 40 will tend to flutter in the breeze created by the rotation, enhancing the flickering effect caused by reflective device 30. Furthermore, if reflecting strip 40 is manufactured from a material such as aluminum foil, it may be preferable that the foil is not perfectly smoothed out, as slight wrinkling in the foil will aid in the scattering of light from light source 22 in a more random pattern than would be the case if the foil were uniform and smooth along its length and width "W".

Figure 5:
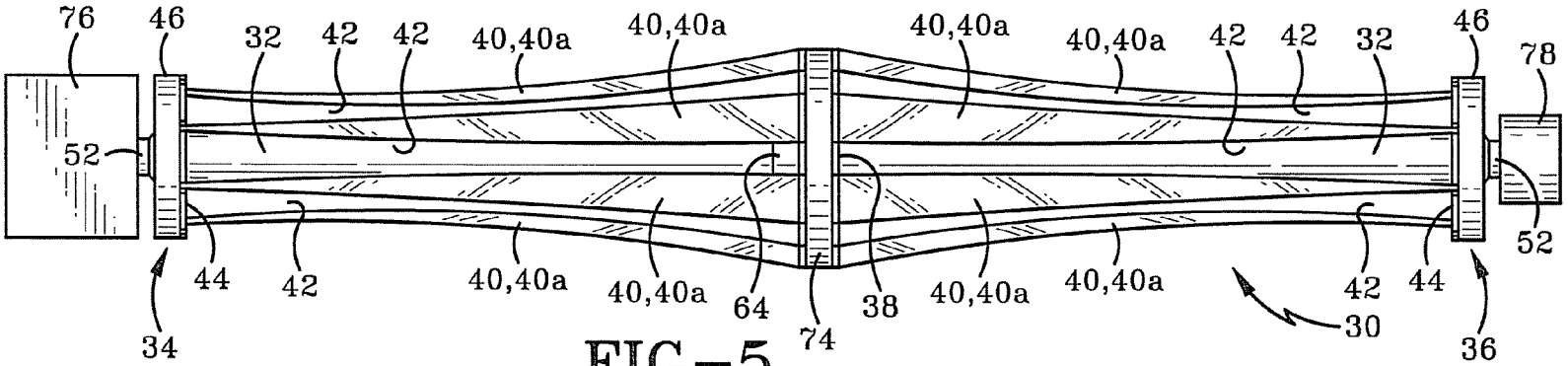
FIG. 5 is a front elevational view of the reflective device shown mounted in the fireplace assembly.
Figure 7:
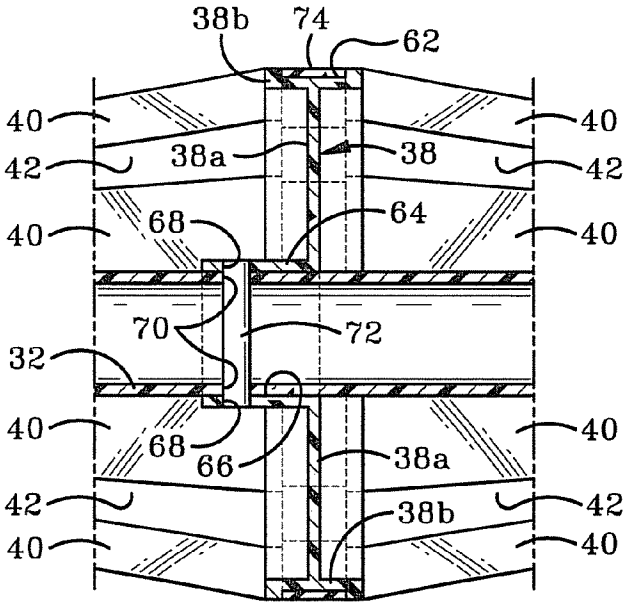
FIG. 7 is a cross-sectional front view of the central portion of the reflective device showing the interlocking engagement of the shaft and the central member.

FIGS. 1 and 5 show the reflective device 30 mounted for use in electric fireplace 10. FIG. 5 shows reflective device 30 mounted between a portion of a motor 76 and bearing 78. Post 52 of first end cap 34 is operatively engaged with motor 76 and post 52 of second end cap 56 is engaged with bearing 78. The direction of rotational motion about the longitudinal axis "X" is indicated in FIG. 1 by arrow "A". When the motor 76 is activated, it initiates rotation of reflective device 30 is rotated. Light "L" from light source 22 strikes reflecting strips 40 and reflects light "L2" back toward screen 20. The rotational motion of reflective device 30 causes the slightly slack reflecting strips 40 to flutter and that, in addition to the presence of the gaps 42 between strips 40, causes the light "L2" reflected back towards screen 20 to flicker. The horizontal orientation of reflecting strips 40 aids in creating a more realistic flame effect because the strips 40 tend to present a larger reflective surface to the light "L" for a longer period of time than in many of the previously known devices. Furthermore, the upwardly moving horizontal reflection more closely mimics heat rising in the flames simulated by the fireplace assembly.

It will be understood that instead of the first and second end caps 34, 36 and the intermediate member 38 being separate components that are fixedly mounted to shaft 32, the first and second end caps 34, 36, the intermediate member 38 and shaft 32 may be molded as a unitary member.

It should also be understood that while all of slits 50 in the first and second end caps 34, 36 have been shown as formed in the annular wall and portions of the planar wall, and all of slits 50 are spaced an equivalent distance outwardly away from the shaft 32, slits 50 may be provided in any other location and pattern on one or all of the planar wall, annular wall and lip of the first and second end caps without departing from the spirit of the present invention. Furthermore, more than one row of slits may be provided in first and second end caps so that a plurality of rings of reflecting strips 40 may extend concentrically outwardly from shaft 32.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A reflective device for use in an electric fireplace that includes a screen positioned rearwardly of an artificial log display and ember bed, and a light source for illuminating one of the screen, the artificial log display and ember bed; the reflective device comprising:

a shaft having a first end, a second end and a longitudinal axis extending between the first and second ends and about which the shaft is rotatable, a first end cap disposed at the first end of the shaft;

a second end cap disposed at the second end of the shaft;

a first reflecting strip extending longitudinally between the first and second end caps and being spaced a distance outwardly away from the shaft; and wherein the first reflecting strip is adapted to reflect light from the light source back toward one or more of the screen, the artificial log display and the ember bed; and an intermediate member disposed on the shaft between the first and the second end caps; and the intermediate member includes a first region that is spaced a distance outwardly away from an exterior surface of the shaft, and wherein the first reflecting strip contacts the first region of the intermediate member.

2. The reflective device as defined in claim 1, wherein the reflecting strip engages each of the first and second end caps a first distance away from the exterior surface of the shaft and engages the region of the intermediate member a second distance away from the exterior surface of the shaft; and wherein the second distance is greater than the first distance such that the reflecting strip angles downwardly relative to the exterior surface of the shaft from the intermediate member toward one or both of the first and second end caps.

3. The reflective device as defined in claim 1, further comprising a ring member, and wherein the ring member is complementary to a peripheral outer edge of the intermediate member and is receivable therearound; and the first region is disposed on the peripheral outer edge and the ring member retains the first reflecting strip in abutting contact with the intermediate member.

4. The reflective device as defined in claim 1, wherein each of the first and second end caps and the intermediate member are disposed substantially at right angles to the longitudinal axis of the shaft and are fixedly mounted on the shaft; and wherein the first and second end caps and the intermediate member rotate in unison with the shaft.

5. The reflective device as defined in claim 1, wherein the first and second end caps are substantially identical and each comprises:

a planar wall;

an annular wall extending outwardly from the planar wall and substantially at right angles thereto;

a post extending outwardly from an exterior surface of the planar wall; the post being adapted to be used to mount the reflective device for rotation about the longitudinal axis of the shaft;

a boss extending inwardly away from an interior surface of the planar wall and generally in alignment with the post; the boss being configured to engage the shaft.

6. The reflective device as defined in claim 5, wherein each of the first and second end caps further includes a first slit defined in one or both of the planar wall and annular wall, the first slit being positioned so as to receive a first portion of the first reflecting strip therein.

7. The reflective device as defined in claim 6, wherein each of the first and second end caps further includes a second slit defined in one or both of the planar wall and annular wall; the second slit being spaced a distance from the first slit and being positioned so as to receive a second portion of the first reflecting strip therein.

8. The reflective device as defined in claim 1, further comprising a series of pairs of first and second slits defined at intervals in each of the first and second end caps; the first and second slits being defined in one or both of the annular and planar walls; and wherein the first reflecting strip is an elongate member that is threaded back-and-forth between the first and second end caps by threading it through a first pair of first and second slits on the first end cap, then through a first pair of first and second slits on the second end cap, then through a second pair of first and second slits on the first end cap, then through a second pair of first and second slits on the second end cap, and so on until the first reflecting strip has been threaded through substantially all of the series of pairs of first and second slits on each of the first and second end caps.

9. The reflective device as defined in claim 1, wherein the first reflecting strip is made from one of a soft and pliable material.

10. The reflective device as defined in claim 9, wherein the material is aluminum foil.

11. The reflective device as defined in claim 2, further comprising a second reflecting strip extending longitudinally between the first and second end caps and being spaced a distance outwardly away from the shaft; and wherein the second reflecting strip is spaced a distance away from the first reflecting strip and is separated therefrom by a gap; and wherein the second reflecting strip contacts a second region of the intermediate member a spaced distance from the first region thereof.

12. The reflective device as defined in claim 11, wherein each of the first and second reflecting strips has a length as measured between the first and second end caps, and a width disposed at right angles to the length, and wherein the width of each of the first and second reflecting strips is between ⅛ inch to 1 inch, and the gap has a width of between ⅛ inch to 1 inch.

13. The reflective device as defined in claim 5, further comprising a plurality of additional reflecting strips that are each substantially identical to the first and second reflecting strips, each additional reflecting strip extending longitudinally between the first and second end caps, contacting the intermediate member and being spaced a distance outwardly away from the shaft; and where adjacent additional reflecting strips are separated from each other by a gap that is substantially identical to the gap between the first and second reflecting strips, such that the plurality of additional reflecting strips and the first and second reflecting strips form a reflective ring spaced a distance outwardly away from the shaft, and wherein the ring of reflecting strips is substantially concentric with the shaft.

14. The reflective device as defined in claim 8, wherein the first reflecting strip has a length as measured between the first and second end caps, and a width disposed at right angles to the length, and each of the first and second slits has a width and the width of the first reflecting strip is greater than the width of the first and second slits, and wherein the first reflecting strip is compressed in width when threaded through each of the first and second slits.

15. The reflective device as defined in claim 1, wherein the first reflecting strip has an interior surface and an exterior surface and both of the interior and exterior surfaces are reflective in nature.

16. The reflective device as defined in claim 1, wherein the first reflecting strip is retained slackly between the first and second end caps.

17. The reflective device as defined in claim 5, wherein the boss further includes a detent that projects outwardly therefrom and the shaft includes a slot therein that is complementary to the detent; and wherein the boss and shaft are engaged in such a manner that the detent is interlocking received in the slot.

18. The reflective device as defined in claim 5, wherein the first and second end caps further each include a ring member, and wherein the ring member comprises:

a planar wall complementary to the planar wall of one of the first and second end caps;

a hole defined in the planar wall, said hole being located so as to receive the post of the one of the first and second end caps therethrough; and an annular wall extending outwardly away from the planar wall and substantially at right angles thereto; said annular wall being complementary to the annular wall of the one of the first and second end caps; and wherein said ring member is engageable with the one of the first and second end caps.

19. In combination:

an electric fireplace comprising:

a housing;

a transparent panel mounted in the housing;

a simulated ember bed and artificial log display disposed rearwardly of the panel;

a diffusion screen provided rearwardly of the ember bed and log display;

a light source positioned to illuminate one or more of the screen, the ember bed and the log display; and a rotatable reflective device mounted adjacent the one or more of the screen, the ember bed and the log display; wherein the reflective device comprises:

a shaft having a first end, a second end and a longitudinal axis extending therebetween and about which the shaft is rotatable, said shaft being adapted to be operatively connected to a motor to rotate the same;

a first end cap disposed at the first end of the shaft;

a second end cap disposed at the second end of the shaft;

an intermediate member extending outwardly from the shaft between the first and second end caps;

a plurality of reflecting strips, each reflecting strip extending longitudinally between the first and second end caps and contacting a region of the intermediate member thereinbetween; each reflecting strip being spaced a distance outwardly away from an exterior surface of the shaft, wherein adjacent reflecting strips are separated from each other by a longitudinal gap; and wherein the reflecting strips are adapted to reflect light from the light source back toward one or more of the screen, the ember bed and the log display.

20. The combination as defined in claim 19, wherein the reflecting strips engage each of the first and second end caps a first distance away from the exterior surface of the shaft and engage the regions of the intermediate member a second distance away from the exterior surface of the shaft; and wherein the second distance is greater than the first distance so that the reflecting strips angle downwardly relative to the exterior surface of the shaft from the intermediate member toward both of the first and second end caps.

* * * * *